US011796266B2

(12) United States Patent
Jünger et al.

(10) Patent No.: US 11,796,266 B2
(45) Date of Patent: Oct. 24, 2023

(54) UPPER RECEIVER FOR A FIREARM

(71) Applicant: STEYR ARMS GmbH, Kleinraming (AT)

(72) Inventors: Lukas Jünger, Aschbach (AT); Florian Richler, Vienna (AT); Mario Brandstetter, Neuzeug (AT); Johannes Wagner, Aschbach (AT); Alexander Giesen, Hechingen (DE); Michael Engesser, Sulzbach (AT)

(73) Assignee: STEYR ARMS GmbH, Kleinraming (AT)

( * ) Notice: Subject to any disclaimer, the term of this patent is extended or adjusted under 35 U.S.C. 154(b) by 175 days.

(21) Appl. No.: 17/613,178

(22) PCT Filed: Mar. 30, 2020

(86) PCT No.: PCT/AT2020/060133
§ 371 (c)(1),
(2) Date: Nov. 22, 2021

(87) PCT Pub. No.: WO2020/232481
PCT Pub. Date: Nov. 26, 2020

(65) Prior Publication Data

US 2022/0316830 A1 Oct. 6, 2022

(30) Foreign Application Priority Data

May 23, 2019 (AT) ..... A 504772019

(51) Int. Cl.
*F41A 3/44* (2006.01)
*F41A 3/66* (2006.01)
(Continued)

(52) U.S. Cl.
CPC ..... *F41A 3/44* (2013.01); *F41A 3/66* (2013.01); *F41A 11/00* (2013.01); *F41A 21/48* (2013.01)

(58) Field of Classification Search
CPC ..... F41A 3/44; F41A 3/66; F41A 11/00
(Continued)

(56) References Cited

U.S. PATENT DOCUMENTS 4,972,617 A * 11/1990 Major ..... F41A 3/80 89/197
8,087,194 B1 * 1/2012 Vuksanovich ..... F41A 21/481 42/75.01
(Continued)

FOREIGN PATENT DOCUMENTS

BE 895677 A 7/1983
DE 102007011504 A1 9/2008
(Continued)

OTHER PUBLICATIONS

Office Action from corresponding Austrian Application No. A 50477/2019, dated Dec. 3, 2019.
(Continued)

*Primary Examiner* — Samir Abdosh
(74) *Attorney, Agent, or Firm* — Hoffmann & Baron, LLP

(57) ABSTRACT

The invention relates to an upper receiver for a firearm, comprising a supporting part, which supports a barrel bushing for receiving a barrel, a guide for a longitudinally movable breech carrier, and an anchor for a sight. The guide for the breech carrier is formed on the underside of a rail block preferably made of metal which has the anchor for the sight on its upper side, and the supporting part is also preferably made of metal and mounted both to the barrel bushing and to the rail block via removable fasteners.

20 Claims, 4 Drawing Sheets

(51) Int. Cl.
*F41A 11/00* (2006.01)
*F41A 21/48* (2006.01)

(58) Field of Classification Search
USPC ..... 89/187.01
See application file for complete search history.

(56) References Cited

U.S. PATENT DOCUMENTS

2012/0131834 A1* 5/2012 Barrett ..... F41A 5/28 42/75.02
2012/0131835 A1* 5/2012 Barrett ..... F41A 21/481 42/75.02
2014/0033590 A1* 2/2014 Gomez ..... F41A 21/48 42/75.02
2014/0075817 A1* 3/2014 Gomez ..... F41A 21/48 42/75.02
2014/0076146 A1* 3/2014 Gomez ..... F41A 21/48 89/191.01
2015/0007478 A1* 1/2015 Barrett ..... F41A 21/481 42/75.02
2015/0059221 A1* 3/2015 Bero ..... F41A 3/72 42/16
2016/0033219 A1* 2/2016 Meier ..... F41A 5/26 42/17
2017/0314880 A1* 11/2017 Dienno ..... F41A 17/00
2022/0205746 A1* 6/2022 Wall ..... F41A 15/16
2022/0282950 A1* 9/2022 Aldstadt ..... F41C 23/16

FOREIGN PATENT DOCUMENTS

DE 102010009488 B3 4/2011
WO 2017106308 A1 6/2017
WO 2018201172 A1 11/2018

OTHER PUBLICATIONS

PCT International Search Report from corresponding application PCT/AT2020/060133, dated Jun. 17, 2020.
English translation of the International Preliminary Report on Patentability dated Jan. 27, 2021 in corresponding International Application No. PCT/AT2020/060133.

* cited by examiner

UPPER RECEIVER FOR A FIREARM

CROSS-REFERENCE TO RELATED APPLICATIONS

This application is a National Phase application of International Application No. PCT/AT2020/060133 filed Mar. 30, 2020 which claims priority to Austrian Patent Application No. A 50477/2019 filed May 23, 2019, the disclosures of which are incorporated herein by reference.

TECHNICAL FIELD

The disclosed subject matter relates to an upper receiver for a firearm, comprising a supporting part, which supports a barrel bushing for receiving a barrel, a guide for a longitudinally movable breech carrier, and an anchor for a sight.

BACKGROUND

The prior art discloses upper receivers for firearms, e.g. machine guns, made of plastics material in which the barrel bushing, the breech-carrier guide and the sight anchor are embedded as separate parts. When the firearm heats up, e.g. during a relatively long period of sustained fire, the plastics material deforms and no longer returns to its starting position. The weapon is then misaligned and, at worst, malfunctions may occur, right through to the gun becoming unusable.

BRIEF SUMMARY

The aim of the disclosed subject matter is to overcome the drawbacks of said prior art and to provide an upper receiver for a firearm which provides high target accuracy and operational reliability even under high stress.

This aim is achieved by an upper receiver for a firearm, comprising a supporting part, which supports a barrel bushing for receiving a barrel, a guide for a longitudinally movable breech carrier, and an anchor for a sight, wherein the guide for the breech carrier is formed on the underside of a rail block made of metal which has the anchor for the sight on its upper side, the supporting part being made of metal and being screwed both to the barrel bushing and to the rail block.

According to the disclosed subject matter, the breech-carrier guide and the sight anchor are implemented in a common rail block, which is rigidly screwed to the barrel bushing via the supporting part made of metal. As a result, the sight is very securely connected to the barrel bushing, and therefore material drift and thus misalignment are prevented even under high stress. At the same time, as part of the rail block, the breech-carrier guide is very securely connected to the barrel bushing via the supporting part, and this prevents malfunctions even when the gun is used for relatively long periods of time. As a result, an upper receiver is obtained that has high target accuracy and operational reliability.

It is particularly advantageous for the supporting part to be formed by two receiver halves made of metal, which receive the barrel bushing and the rail block therebetween, the upper side of the rail block being exposed, and said receiver halves each being screwed to the barrel bushing and the rail block. The receiver halves can be manufactured in a simple manner, e.g. by milling, and, when the gun is being assembled, they only need to be screwed to the barrel bushing and the rail block. It is also very simple to dismantle the gun, by loosening the screw connections and separating the two receiver halves.

According to an optional feature of the disclosed subject matter, the rail block partially overlaps the barrel bushing, the barrel bushing being screwed to the supporting part by means of screws that penetrate the rail block in the overlap region. The screws connecting the barrel bushing to the supporting part thus simultaneously fix the rail block in the supporting part.

Optionally, in this case, the rail block and the barrel bushing have aligning holes in their overlap region, into which holes a locating pin is inserted, which simplifies assembly of the gun. By means of the locating pin, the rail block and barrel bushing can first be oriented relative to one another and temporarily fixed and can then be screwed together with the supporting part or the receiver halves.

The sight could be mounted directly on the anchor provided for this purpose on the upper side of the rail block. To do this, the sight anchor of the rail block may for example be constructed directly in the form of a Picatinny rail. According to a further variant, it is however provided that the anchor comprises at least one dovetail guide for a Picatinny rail for detachably mounting the sight, such that a wide range of commercially available Picatinny rails can be used.

In another configuration of the disclosed subject matter, the supporting part comprises a sliding guide for a control pin of a breech that is movable in the breech carrier. For example, the breech carrier contains a breech head that can be twist-locked in the barrel bushing, and the control pin of the breech head engages in the sliding guide of the supporting part such that, during repeating of the gun, it is accordingly detached (unlocked) from the barrel bushing and is then twist-locked therein again, as is known in the art.

It is particularly advantageous here for the sliding guide to be reinforced by a reinforcing rail, which is made of a material that is different from the metal of the supporting part, in particular made of steel. The reinforcing rail may for example be embedded into the supporting part or is in particular screwed to the inside of a receiver half. When the breech repeats, the control pin exerts a sudden, high force on the sliding guide, which is absorbed by the reinforcing rail in order to prevent signs of wear.

Advantageously, the supporting part is made of light metal, in particular aluminum, which results in high deformation resistance with a low weight.

When the supporting part is formed by two receiver halves, these halves can also be used for anchoring other parts of the gun in a particularly simple manner. For example, the receiver halves receive a downwardly projecting magazine holder therebetween and are screwed thereto, which allows for simple assembly.

BRIEF DESCRIPTION OF THE DRAWINGS

The disclosed subject matter will be explained in greater detail in the following with reference to an embodiment shown in the accompanying drawings, in which.

DETAILED DESCRIPTION

Figure 1:
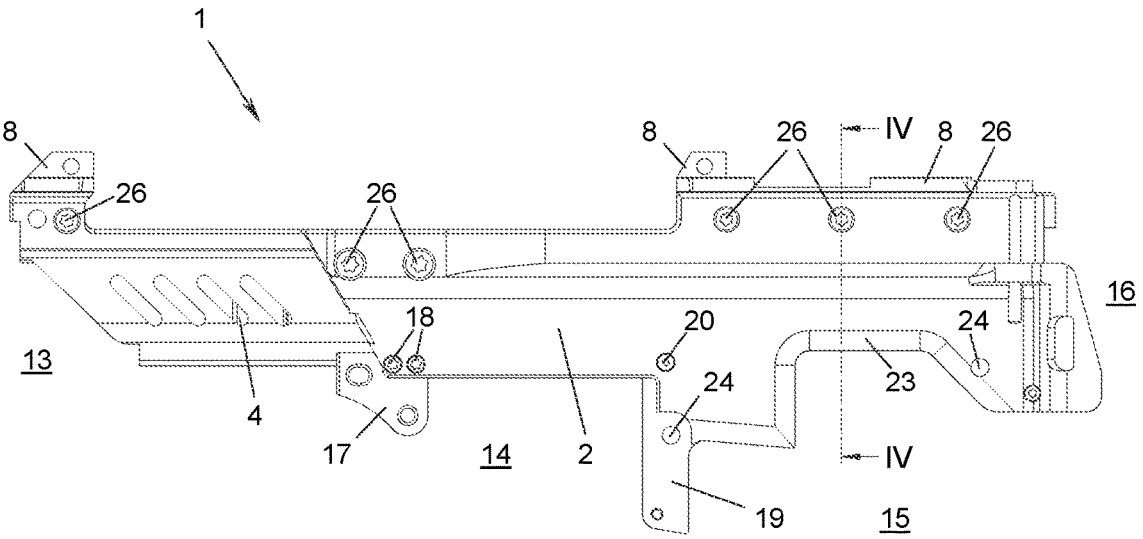
FIGS. 1 and 2 are a side view and a plan view of the upper receiver of the disclosed subject matter.
Figure 2:
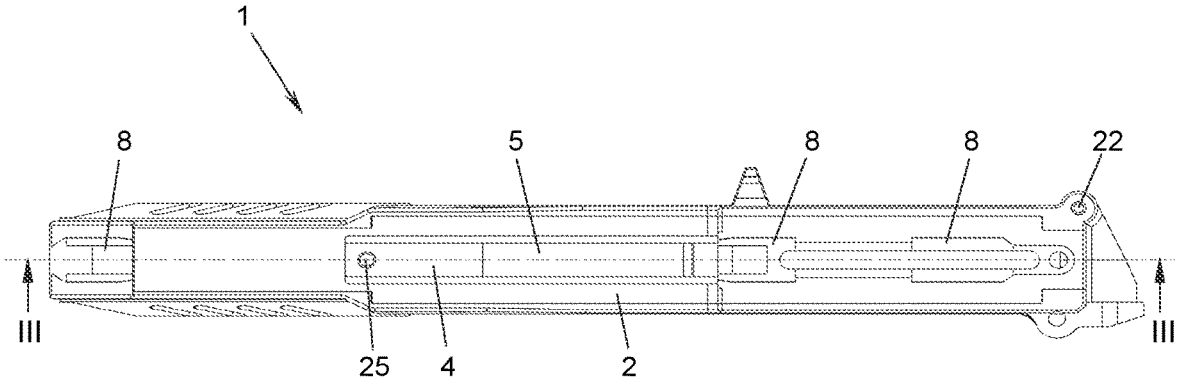

FIGS. 1-6 show an upper receiver 1 for a firearm (not shown in greater detail). The upper receiver 1 comprises a supporting part 2 made of metal, which can be formed in one piece or composed of two receiver halves 3', 3" (as shown here). A barrel bushing 4 for receiving a barrel (not shown) and a rail block 5 made of metal are arranged in the supporting part 2 and between the receiver halves 3', 3", respectively, and have multiple functions: First of all, on its underside, the rail block 5 comprises a guide 6 for a breech carrier 7, which is longitudinally movable relative to the supporting part 2 and the barrel bushing 4 in the guide 6. In addition, the rail block 5 is equipped with an anchor 8 for a sight (not shown) on its upper side. Furthermore, when the supporting part 2 is in the form of two side-plate-like receiver halves 3', 3", the rail block 5 forms the upper boundary of the upper receiver 1, i.e. forms together with the receiver halves 3', 3" a downwardly open upper receiver 1 that is approximately U-shaped in cross section.

Figure 3:
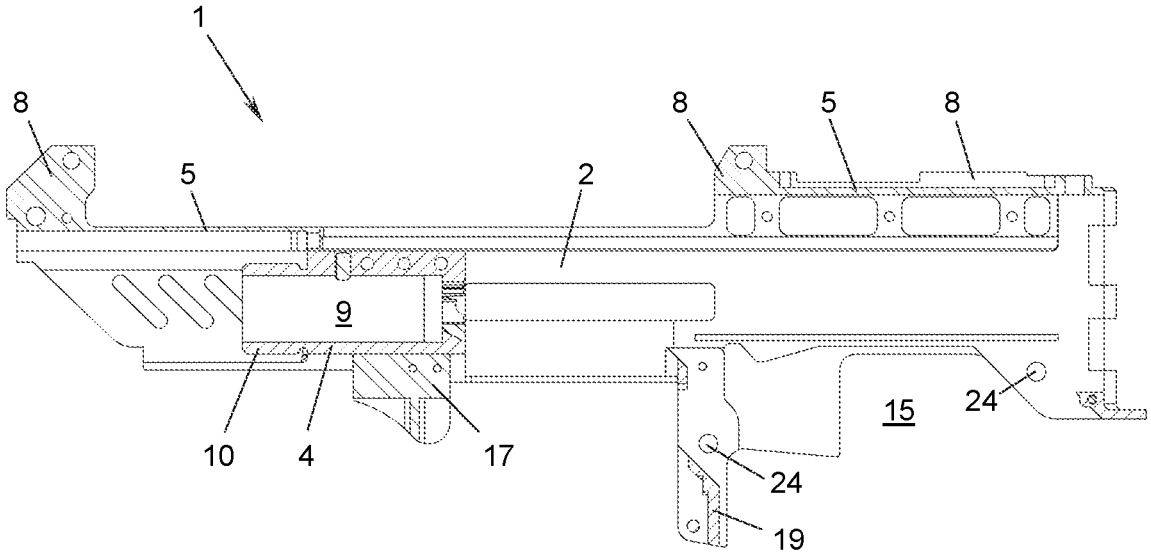
FIG. 3 is a sectional view along the sectional line III-III from FIG. 2.
Figure 4:
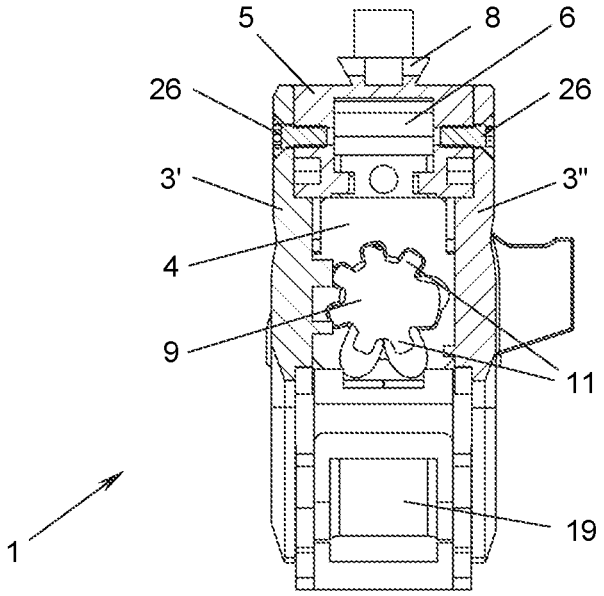
FIG. 4 is a sectional view along the sectional line IV-IV from FIG. 1.
Figure 5:
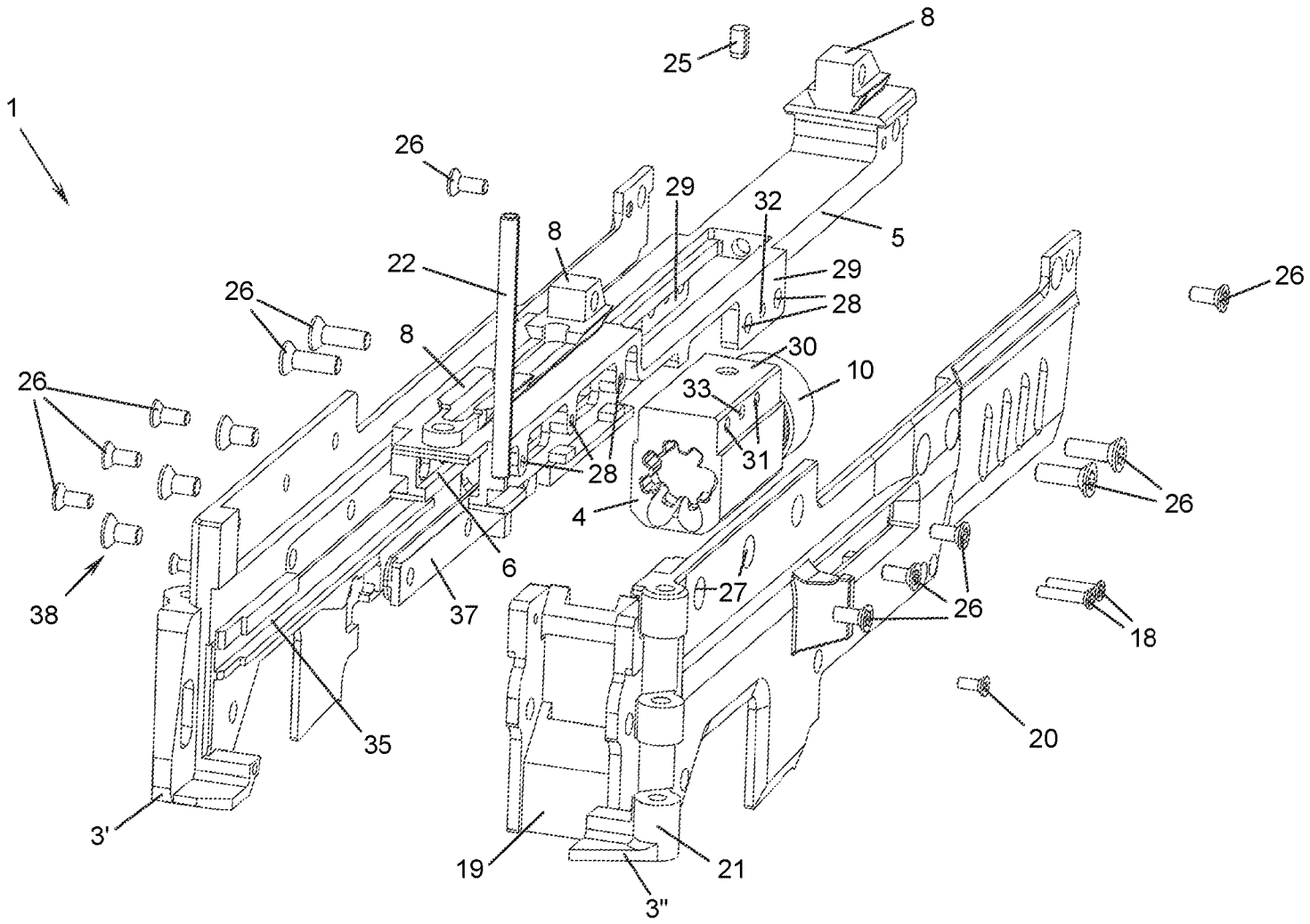
FIGS. 5 and 6 are two different exploded perspective views of the upper receiver from FIGS. 1-4 in connection with some other gun components received therein.
Figure 6:
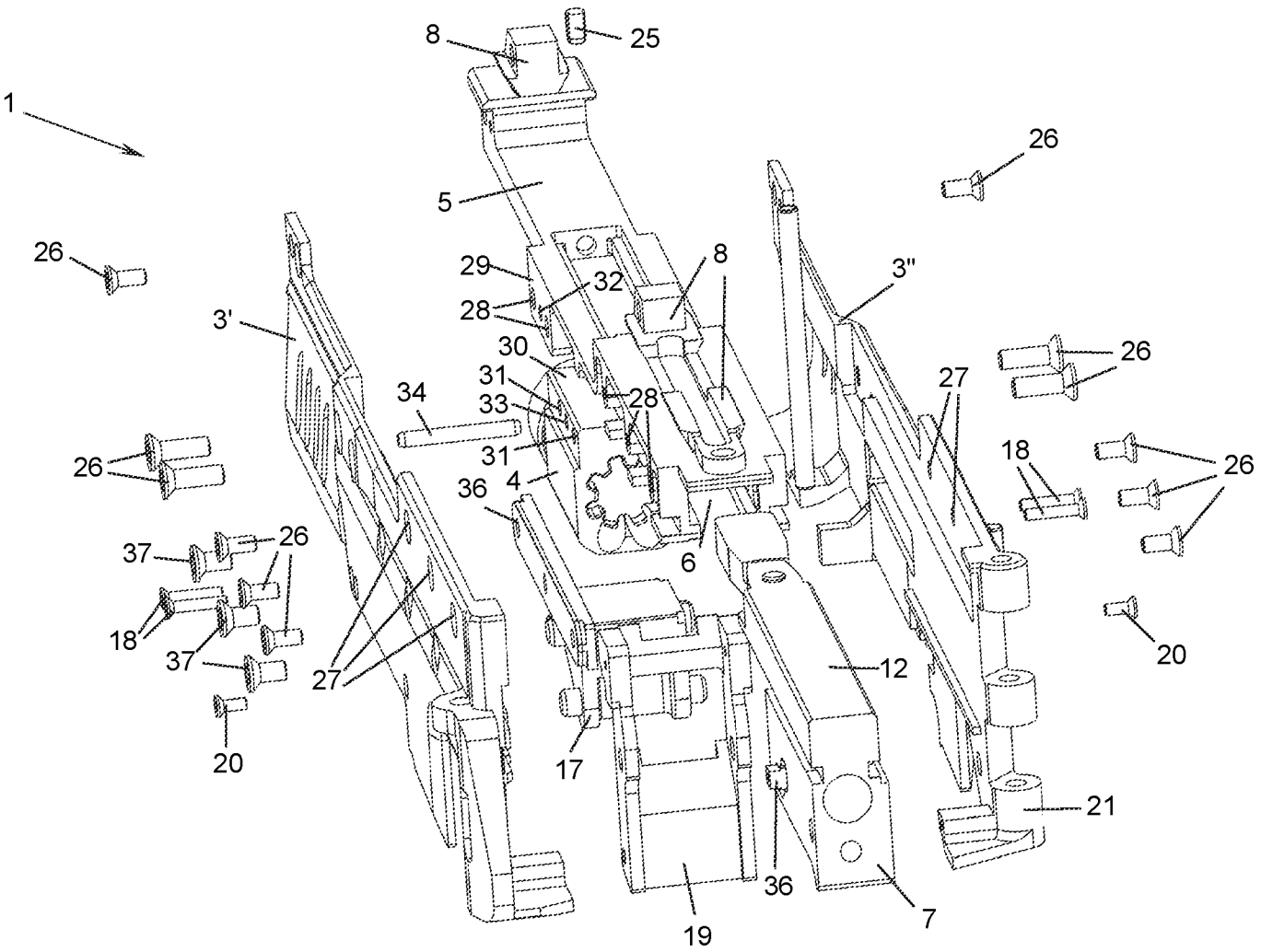

The terms "lower" and "upper" relate to the normal usage position of the gun, as shown in FIGS. 1, 3 and 4. The terms "longitudinally movable" and "longitudinal direction" relate to the barrel direction or axis of the gun. The terms "front" and "rear" relate to the muzzle side (front) and the shooter side (rear) of the gun. The terms "left" and "right" relate to the direction of view of the shooter when shooting.

The barrel bushing 4 has a central hole 9 for receiving the rear end of the barrel (not shown), which can for example be screwed to an outer thread 10 of the barrel bushing 4 by means of a cap nut. On its rear side, the barrel bushing 9 has a circle of bayonet grooves 11, to which a toothed-collar-like breech head can be twist-locked that is longitudinally movable and rotatably mounted in the breech carrier 7, as is known in the art.

In the example shown, the breech-carrier guide 6 on the underside of the rail block 5 is a T groove, in which an upper part 12 of the breech carrier 7, which upper part 12 is T-shaped in profile, is slidably guided. The breech-carrier guide 6 could, however, also have a different cross-sectional shape, which interacts with an accordingly complementary part of the breech carrier 7 to mount this in the upper receiver 1 in a longitudinally movable manner.

The sight anchor 8 of the rail block 5 may for example be formed by holes, tabs, undercuts or the like on the upper side of the rail block 5. In the example shown, the sight anchor 8 comprises a plurality of dovetail guides distributed over the longitudinal direction of the rail block 5, onto which a Picatinny rail (not shown) having a dovetail groove on the underside can be slid; in a manner known per se, the sight can then be adjustably and detachably mounted on the Picatinny rail, in the same way as other add-on parts of the gun, e.g. grenade launchers, bayonets, laser pointers, spotlights, etc.

The other components of the gun are generally also mounted on the upper receiver 1, more specifically on the supporting part 2, for example a fore-end in the region 13 in front of the upper receiver 1, a magazine in the region 14 below the upper receiver 1, a trigger mechanism in the region 15 below the upper receiver 1, and a stock or shoulder rest in the region 16 to the rear of the upper receiver 1. For anchoring these gun components, the upper receiver 1 may for example contain a fore-end connection block 17, which is received between the receiver halves 3', 3" so as to project downwards and is screwed thereto by means of screws 18; a downwardly projecting magazine holder 19, which is received between the receiver halves 3', 3" and is screwed thereto by means of screws 20; a hinge 21 comprising a hinge pin 22 in the rear region of the upper receiver 1, for example on the rear end of the right-hand receiver half 3", in order to articulate a hinged shoulder support or a folding stock; and a receptacle 23 comprising anchoring holes 24 for anchoring a trigger mechanism in the region 15, which interacts with the breech carrier 7 and the breech head guided therein. The barrel (not shown) can be oriented in its rotational direction by means of a dowel pin 25, which penetrates the wall of the barrel bushing 4 and engages in a corresponding recess in the barrel.

By forming the breech-carrier guide 6 and the sight anchor 8 on the common rail block 5, the breech-carrier guide 6 and the sight 8 are rigidly fixed in position relative to one another. By screwing both the barrel bushing 4 and the rail block 5 to the common supporting part 2, more specifically to each of the receiver halves 3', 3", the barrel bushing 4 is also rigidly fixed in position relative to the breech-carrier guide 6 and the sight anchor 8. This results in stable adjustment of the sight anchor 8 relative to the barrel received in the barrel bushing 4 and therefore in dimensionally stable, permanent adjustment of the sight relative to the barrel.

The rail block 5 is screwed to the supporting part 2 or the receiver halves 3', 3" by means of a set of screws 26, which each penetrate lateral holes 27 in the receiver halves 3', 3" and engage in corresponding threaded holes 28 in the rail block 5. The barrel bushing 4 can be screwed to the supporting part 2, or the receiver halves 3', 3", respectively, by means of separate screws or, as shown, some of the screws 26 can be co-used for this screwing. For this purpose, the rail block 5 overlaps the upper part 30 of the barrel bushing 4 by way of two downwardly directed attachments 29. In this overlap region, the screws 26 penetrate the holes 28 in the attachments 29 of the rail block 5 and engage in threaded holes 31 in the upper part 30 of the barrel bushing 4. The barrel bushing 4 is thus fixed in the supporting part 2 at the same time as the rail block 5.

In order to make it easier to screw together, the barrel bushing 4 can be pre-fixed to the rail block 5. To do this, the rail block 5 and the barrel bushing 4 have holes 32, 33 that align in the overlap region, into which holes a locating pin 34 can be inserted, which temporarily holds the barrel bushing 4 between the attachments 29 of the rail block 5 until it is screwed to the receiver halves 3', 3" by means of the screws 26. When screwed together, the receiver halves 3', 3" retain the locating pin 34 between them.

In order to lock and unlock the breech head guided in the breech carrier 7, the supporting part 2 comprises a sliding guide 35 for a control pin 36 of the breech or breech head guided in the breech carrier 7 on its inside, in particular on the left-hand receiver half 3' here. In the example shown, the sliding guide 35 is a groove extending in the longitudinal direction of the gun on the inside of the receiver half 3'. In order to reinforce the sliding guide 35, it can be reinforced with an insert made of a harder material than the supporting part 2, for example made of steel, if the supporting part 2 is e.g. made of light metal, such as aluminum. In the example shown, for reinforcing the sliding guide 35, a reinforcing rail 37 is provided which forms a portion of the upper side wall of the sliding guide groove and is screwed to the receiver half 3' by means of screws 38.

Instead of such a reinforcing rail 37 in portions, the entire sliding guide 35 could also be produced from an insert made of harder material than the receiver half 3', e.g. of high-carbon steel.

The disclosed subject matter is not limited to the embodiments set out, but instead covers all the variants, modifications and combinations thereof that fall within the scope of the appended claims.

What is claimed is:

1. An upper receiver for a firearm, comprising a supporting part, which supports a barrel bushing for receiving a barrel, a guide for a longitudinally movable breech carrier, and an anchor for a sight, wherein the guide for the breech carrier is formed on an underside of a rail block which has the anchor for the sight on its upper side, the supporting part being mounted both to the barrel bushing and to the rail block.

2. The upper receiver according to claim 1, wherein the supporting part is formed by two receiver halves made of metal, which receive the barrel bushing and the rail block therebetween, the upper side of the rail block being exposed, and said receiver halves each being mounted to the barrel bushing and the rail block.

3. The upper receiver according to claim 1, wherein the rail block partially overlaps the barrel bushing, in an overlap region, the barrel bushing being mounted to the supporting part by means of removable fasteners that penetrate the rail block in the overlap region.

4. The upper receiver according to claim 3, wherein the rail block and the barrel bushing have aligning holes in their overlap region, into which holes a locating pin is inserted.

5. The upper receiver according to claim 1, wherein the anchor comprises at least one dovetail guide for a Picatinny rail for detachably mounting the sight.

6. The upper receiver according to claim 1, wherein the supporting part comprises a sliding guide for a control pin of a breech that is movable in the breech carrier.

7. The upper receiver according to claim 6, wherein the sliding guide is reinforced by a reinforcing rail, which is made of a material that is different from the supporting part which is made of metal.

8. The upper receiver according to claim 2, wherein the sliding guide is reinforced by a reinforcing rail, which is made of a material that is different from the supporting part which is made of metal, and wherein the reinforcing rail is mounted to an inside of one of the receiver halves.

9. The upper receiver according to claim 1, wherein the supporting part is made of light metal.

10. The upper receiver according to claim 2, wherein the receiver halves receive a downwardly projecting magazine holder therebetween and are mounted thereto.

11. The upper receiver according to claim 7, wherein the reinforcing rail is made of steel.

12. The upper receiver according to claim 9, wherein the supporting part is made of aluminum.

13. The upper receiver according to claim 2, wherein the rail block partially overlaps the barrel bushing in an overlap region, the barrel bushing being mounted to the supporting part by means of removable fasteners that penetrate the rail block in the overlap region.

14. The upper receiver according to claim 13, wherein the rail block and the barrel bushing have aligning holes in their overlap region, into which holes a locating pin is inserted.

15. The upper receiver according to claim 2, wherein the supporting part comprises a sliding guide for a control pin of a breech that is movable in the breech carrier.

16. The upper receiver according to claim 15, wherein the sliding guide is reinforced by a reinforcing rail, which is made of a material that is different from the supporting part which is made of metal.

17. The upper receiver according to claim 16, wherein the reinforcing rail is made of steel.

18. The upper receiver according to claim 1, wherein the supporting part is mounted both to the barrel bushing and to the rail block by removable fasteners.

19. The upper receiver according to claim 1, wherein the rail block and supporting part are made of metal.

20. The upper receiver according to claim 18, wherein the removable fasteners are screws.

* * * * *